United States Patent [19]

Kamin et al.

[11] 4,019,841

[45] Apr. 26, 1977

[54] YOKE MECHANISM FOR FLUID DISPLACEMENT DEVICE

[76] Inventors: Arthur Kamin, 303 W. Hawley, Mundelein, Ill. 60060; Clifford A. Evans, Rte. No. 3 Box 85, Waukegan, Ill. 60085

[22] Filed: July 17, 1975

[21] Appl. No.: 596,857

Related U.S. Application Data

[63] Continuation-in-part of Ser. No. 437,361, Jan. 28, 1974, abandoned.

[52] U.S. Cl. ..... 418/257

[51] Int. Cl.[2] ..... F04C 1/00

[58] Field of Search ..... 418/257, 253, 254, 255, 418/241

[56] References Cited

UNITED STATES PATENTS

| | | | |
|---|---|---|---|
| 127,490 | 6/1872 | Lamoree | 418/254 |
| 489,124 | 1/1893 | Fuller | 418/254 |
| 507,830 | 10/1893 | Morse | 418/255 |
| 1,637,484 | 8/1927 | Hapgood | 418/257 |
| 1,718,112 | 6/1929 | Cavallier | 418/254 |
| 1,857,931 | 5/1932 | Axien | 418/254 |
| 2,911,955 | 10/1959 | Steen | 418/254 |
| 3,356,292 | 12/1967 | Brewer et al. | 418/241 X |

*Primary Examiner*—C. J. Husar
*Assistant Examiner*—Leonard Smith
*Attorney, Agent, or Firm*—Edmond T. Patnaude

[57] ABSTRACT

A yoke mechanism for supporting a plurality of orbitable vanes includes two pair of identical yoke members to which the vanes are pivotally connected for self adjustment of the vanes within the associated fluid chamber.

6 Claims, 2 Drawing Figures

YOKE MECHANISM FOR FLUID DISPLACEMENT DEVICE

The present invention is an improvement over the yoke mechanism disclosed in copending application Ser. No. 353,630, now abandoned, filed by Howard E. Siebold on Apr. 23, 1973 and assigned to the same assignee as is the present invention. It is a continuation-in-part of application Ser. No. 437,361 filed January 28, 1974, and now abandoned.

BACKGROUND OF THE INVENTION

In the positive displacement rotary vane type of meter of pump described in the said copending applications, the yoke and vane assemblies are rotationally and reciprocably mounted on a shaft disposed in eccentric relationship to the axis of rotation of a hollow rotor in which the yoke and vanes are located. To assure that the vanes do not cock relative to the axis of the eccentric shaft, in that prior construction the vanes are secured to the yoke mechanisms at spaced apart locations.

In order to provide a device of this type which is sufficiently accurate to perform satisfactorily as a meter, close dimensional tolerances must be maintained to assure a proper fit between the vanes and the walls of the fluid chamber. Accordingly, the vanes have been fixed to the yoke members and each meter or pump has been custom fitted. Moreover, two different yoke members have been required for each meter or pump.

OBJECTS OF THE INVENTION

Therefore, a principal object of the present invention is to provide a vane type positive displacement fluid meter or pump wherein all of the scotch yoke members are identical.

Another object of this invention is to provide a rotary vane type meter or pump wherein the vanes float in position within the fluid chamber to self adjust for possible misalignment.

A further object of this invention is to reduce the manufacturing cost of a rotary vane type positive displacement meter or pump.

SUMMARY OF THE INVENTION

Briefly, the above and further objects may be realized in accordance with the present invention by pivotally mounting each of a pair of coplanar vanes to a pair of spaced apart yoke members mounted on an eccentric shaft for rotational movement about an axis lying in the plane of the vanes. The yoke members are mounted on respective yoke pins for limited rocking movement about axes extending perpendicular to the plane of the associated vanes. The two vanes and the associated yoke members thus form a parallelogram of pivotally connected arms which permit limited planar movement of the vanes. The pivot connections of the vanes to the yoke members and the rockable mounting of the yoke members on the yoke pins thus permit the vanes to self adjust in an axial direction.

BRIEF DESCRIPTION OF THE DRAWINGS

Further objects and advantages and a better understanding of the present invention can be had by reference to the following detailed description, wherein.

Figure 2:
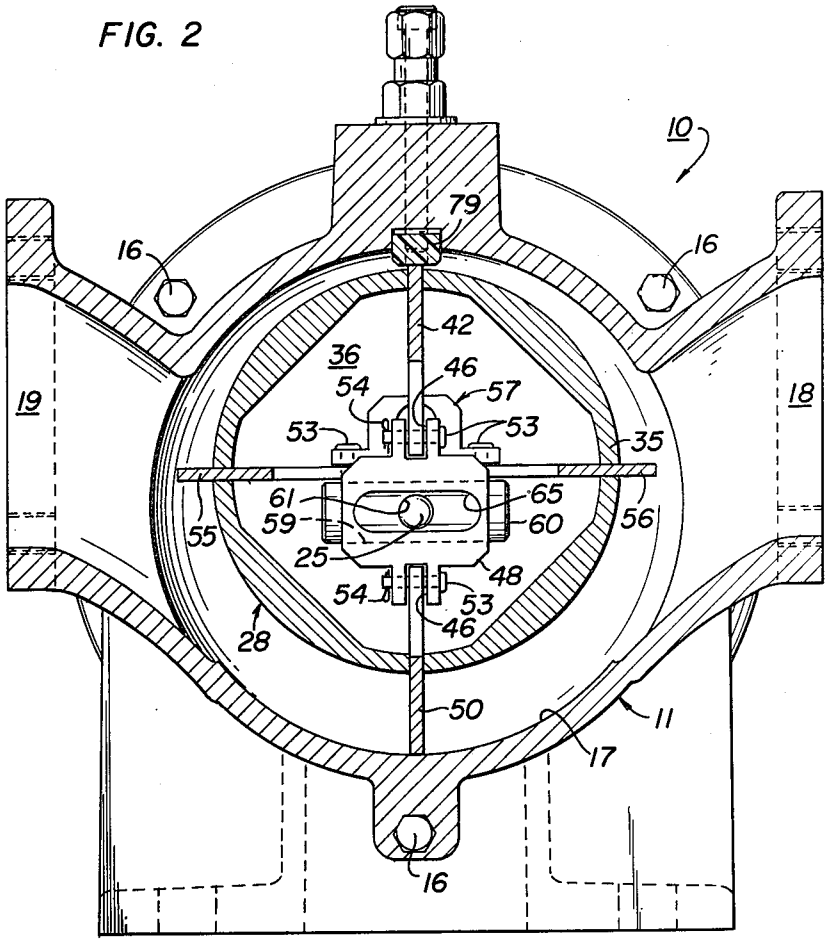
FIG. 2 is a sectional view of the device of FIG. 1 taken along the line 2—2 thereof.
Figure 1:
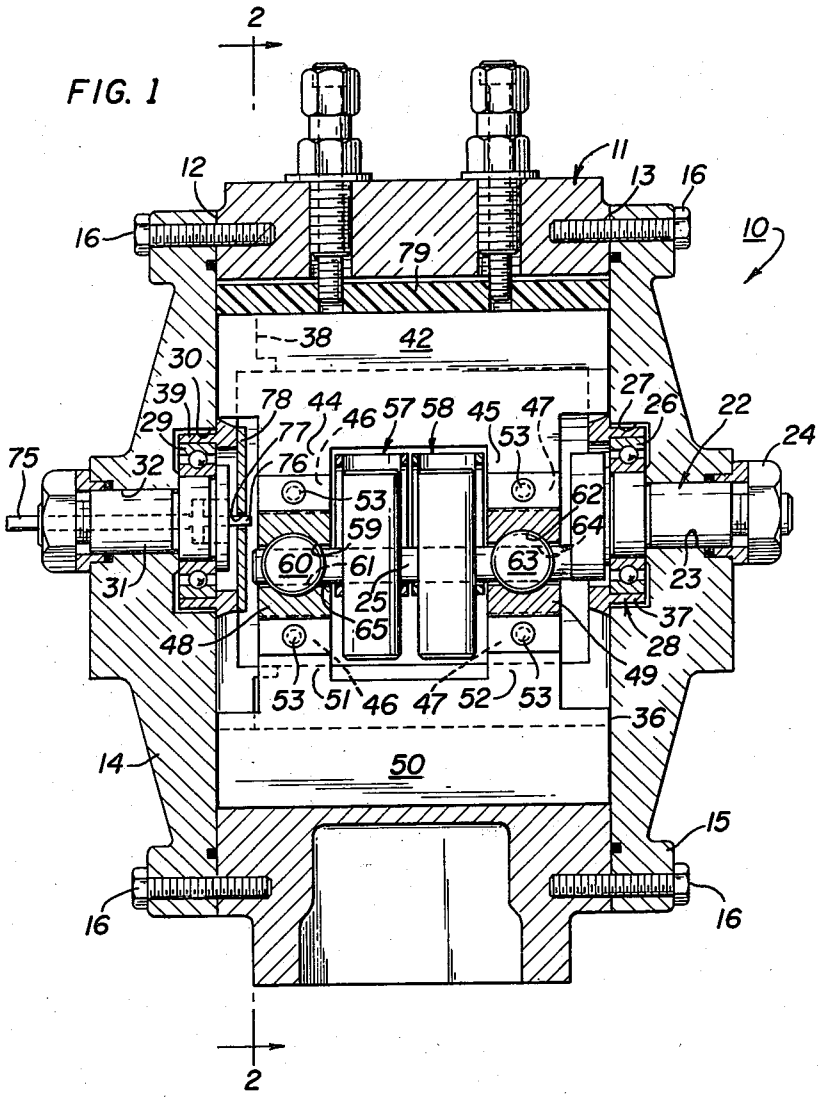
FIG. 1 is a vertically sectioned view of a positive displacement device embodying the present invention.

Referring to the drawing, there is shown a fluid displacement device 10 particularly designed for metering liquids. It comprises as its principal elements a main housing member 11 which is generally tubular and which may be a metal casting having machined end faces 12 and 13 over which a pair of end plates 14 and 15 are sealably secured by means of a plurality of bolts 16. As best shown in FIG. 2, the housing member 11 is generally annular in shape having a substantially arcuate wall portion 17 and fluid inlet and outlet ports 18 and 19.

A yoke shaft 22 is fixedly mounted in a central bore 23 in the end plate 15 by means of a nut 24 threaded on the end of the shaft 22. The shaft 22 has an offset portion 25 on which a plurality of scotch yoke and vane assemblies are rotatably mounted in eccentric relationship to a rotor 28 as more fully described hereinafter. A ball bearing assembly 26 is mounted on the shaft 22 within a counterbore 27 in the innerface of the end plate 15 for rotatably supporting one end of the rotor 28. Another ball bearing assembly 29 is mounted in a counterbore 30 in the inner face of the end plate 14 in alignment with the ball bearing assembly 26 to rotatably mount the other end of the rotor 28. More particularly, the ball bearing assembly 29 is mounted on a sleeve 31 fitted in a central bore 32 aligned with the bore 23 in the opposite end plate 15.

The rotor 28, as best shown in FIG. 2, is a hollow cylinder having an annular body portion 35 and an integral end wall 36 from which an annular flange 37 extends over the outer race of the ball bearing 26 in the counterbore 27. A circular cover plate 38 is mounted over the left-hand open end of the rotor and is secured thereto by suitable machine screws (not shown). The plate 38 has a centrally disposed external annular flange 39 extending over the outer race of the ball bearing 26 in the counterbore 30.

Mounted within the rotor 28 on the offset shaft portion 25 are a plurality of scotch yoke and vane assemblies embodying the present invention. A first vane 42 has a pair of spaced apart mounting legs 44 and 45 respectively disposed in grooves 46 and 47 on a pair of identical, spaced apart yoke members 48 and 49. A second vane 50 has a pair of mounting legs 51 and 52 disposed in grooves 46 and 47 in the yoke members 48 and 49. These second grooves are coplanar with the grooves 46 and 47. The vanes 42 and 50 are thus coplanar and are respectively symmetrical about the longitudinal midpoints thereof, with the mounting legs 44, 45, 51 and 52 being equally spaced from the side edges of the vanes whereby there is no twisting force exerted on the vanes due to the relative motion of the blades and rotor caused by the fluid passing through the meter. The mounting legs of the vanes 42 and 50 are pivotally connected to the yoke members by a plurality of wrist pins 53 which are press fitted in the mounting legs of the vanes and loosely extend through aligned holes in the flanges which define the grooves 46 and 47. Suitable means such as cotter pins 54 hold the wrist pins in place.

As more fully described hereinafter the yoke members 48 and 49 are mounted for limited rocking movement about mutually parallel axes extending parallel to the axes of the wrist pins 53. The vanes 42 and 50 and the associated yoke members 48 and 49 thus form a parallelogram of pivotally connected sides wherein the vanes are movable to a limited extent, with the respective outer and side edges being in mutually parallel relationship at all times.

As best shown in FIG. 2, a second pair of vanes 55 and 56 are pivotably mounted in coplanar relationship to a pair of yoke members 57 and 58 centrally disposed between the yoke members 48 and 49. The second pair of vanes, like the first pair, are connected to the yoke members 57 and 58 by a plurality of wrist pins 53 held in place by cotter pins 54. All four yoke members 48, 49, 55 and 56 are identical and because the vanes are pivotally connected thereto are interchangeable despite slight dimensional differences due to manufacturing tolerances.

The rotor 28 is provided with four equally spaced slots through which the vanes 42, 50, 55 and 56 slidably extend. A yoke pin is pivoted in each yoke member and is rotationally mounted on the shaft portion 25. More particularly the yoke member 48 has a central bore 59 in which a yoke pin 60 is slidably mounted. The yoke pin 60 has a transverse bore 61 into which the shaft portion 25 rotatably extends. In like manner, the yoke member 49 has a central bore 62 in which a yoke pin 63 is slidably mounted and the shaft portion 25 extends through a transverse bore 64 therein. The yoke members 48 and 49 have guide slots 65 in the opposite walls thereof in alignment with the yoke pins 60 and 63 to permit the yoke members to slide back and forth on the eccentric shaft portion 25. The diameter of the offset shaft portion 25 is substantially less than the width of the guide slots 65 thereby to permit the yoke members 48 and 49 to rock on the yoke pins 60 and 63 to enable the vanes 42 and 50 to self adjust in an axial direction. The yoke members 57 and 58 and the associated yoke pins are of like construction.

The vanes each have a width substantially equal to but less than that of the housing member 11 and thus cooperate with the inner walls of the housing end plates 14 and 15 to maintain the yoke members in spaced apart relationship on the shaft portion 25. The mutual spacing between the yoke members is maintained by the leg portions of the vanes.

An output shaft 75 is sealably journaled in the sleeve 31 and has a drive tongue 76 which extends into a slot 77 in a drive plate 78 fastened to the inside of the rotor cover plate 38 whereby the shaft 75 rotates in unison with the rotor 28. When the device 10 is used as a meter, the shaft 75 may be coupled to a suitable counter or other recording instrument and as fluid enters the metering chamber through the inlet 18 and passes to the outlet 19, the rotor and vane assemblies rotate in a clockwise direction as shown in FIG. 2. When used as a pump, a drive motor is connected to the shaft 75. A sealing member 79 which is adjustably mounted in the housing member 11 in line with the axis of rotation of the motor and the axis of the shaft portion 25 prevents unmeasured liquid from flowing through the device when used as a meter and increases the efficiency of the device when used as a pump or as a hydraulic motor.

It may thus be seen by those skilled in the art that the limited movability of the vanes increases the dimensional tolerances which must be held in the manufacture of the yoke members as compared to the fixed connections of the vanes to the yokes. Moreover, the hydraulic pressures which are developed between the edges of the blades and the adjacent walls of the fluid chamber cause the floating vanes to self-adjust to positions spaced from the walls thus avoiding galling or scratching of the vanes, the housing or the end cover plates. It will be understood that the extent of movement of the vanes is not appreciable, being of the order of a few thousandths of an inch or less whereby the accuracy of a meter incorporating this feature of the invention is not appreciably affected. Such limited adjustability of the vane positions does, however, greatly reduce the manufacturing cost of the yoke and vane assemblies and facilitates assembly of the meter or pump.

OPERATION

When used as a positive displacement meter, the device is connected in a fluid line with fluid entering through the inlet 18 and exiting through the outlet 19. With the vanes located as shown in FIG. 2, a force is thus exerted on the vane 50 resulting in a clockwise torque on the yoke members 48 and 49 causing rotation thereof on the shaft portion 25. Also, a clockwise torque is exerted on the rotor 28 by the vane 50 causing the rotor to rotate about its central axis and drive the output shaft 75 as well as the vanes 55 and 56 and the yoke members 57 and 58 to which they are connected. Since the vanes are mounted to the respective yoke members at symetrically disposed locations the vanes do not tend to twist in the rotor slots as would be the case if they were supported at off-center, unbalanced locations thereon. Since the facial end areas of the rotor 28 are equal as are the end edges of the vanes, the rotor and the vanes are hydraulically balanced in an axial direction within the metering chamber thereby to rotate freely therein.

While the present invention has been described in connection with a single embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What we claim is:

1. A positive displacement fluid device, comprising
a fluid chamber,
a rotor journaled for rotation in said chamber,
said rotor being provided with a plurality of sets of diametrically opposed slots,
a shaft offset from the axis of rotation of said rotor,
a plurality of slide members each having a transverse opening therein rotatably receiving said shaft,
a plurality of yoke members each having a bore therein slidably receiving a respective one of said slide members,
a first pair of vanes disposed in one of said sets of slots with each of said vanes being connected by freely pivotably connections to each of a pair of said yoke members to form a parallelogram, and
a second pair of vanes disposed in another of said sets of slots with each of said second pair of vanes being connected by freely pivotable connections to each of another pair of said yoke members to form a parallelogram,
whereby said pairs of vanes are movable in the planes of the respectively associated slots to provide limited self-adjustment of said vanes in said chamber.

2. The invention according to claim 1 wherein all of said yoke members are identical in construction.

3. The invention according to claim 1 wherein said yoke members are each provided with a pair of mutually coplanar grooves into respective ones of which the corresponding pair of vanes extends.

4. The invention according to claim 3 wherein said vanes are pivotally connected to the associated ones of said yoke members by means comprising pintles extending through aligned openings in said vanes and said yoke members.

5. The invention according to claim 3 wherein each of said vanes is pivotally connected to the associated one of said yoke members by means comprising a pintle press fitted into said vane with the ends of said pintle being rotatably received in aligned openings in said yoke member on opposite sides of the associated groove.

6. The invention according to claim 1 wherein the yoke members to which said first pair of vanes are connected are disposed between the yoke members to which said second pair of vanes are connected.

* * * * *

UNITED STATES PATENT AND TRADEMARK OFFICE

CERTIFICATE OF CORRECTION

PATENT NO. : 4,019,841

DATED : April 26, 1977

INVENTOR(S) : Arthur Kamin and Clifford A. Evans

It is certified that error appears in the above-identified patent and that said Letters Patent are hereby corrected as shown below:

Column 4, line 58 "pivotably" should be -pivotable-.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*